US008834223B2

(12) United States Patent
Omlor

(10) Patent No.: US 8,834,223 B2
(45) Date of Patent: Sep. 16, 2014

(54) APPARATUS FOR RETAINING AN ITEM IN A BODY OF WATER

(75) Inventor: Robert H. Omlor, Pottsville, PA (US)

(73) Assignee: RaftSaver, LLC, Pottsville, PA (US)

( * ) Notice: Subject to any disclaimer, the term of this patent is extended or adjusted under 35 U.S.C. 154(b) by 0 days.

(21) Appl. No.: 13/539,589

(22) Filed: Jul. 2, 2012

(65) Prior Publication Data

US 2013/0095713 A1 Apr. 18, 2013

Related U.S. Application Data

(60) Provisional application No. 61/546,164, filed on Oct. 12, 2011.

(51) Int. Cl.
*A47G 33/12* (2006.01)
*B63C 9/02* (2006.01)

(52) U.S. Cl.
CPC ..... *B63C 9/02* (2013.01)
USPC ..... 441/136

(58) Field of Classification Search
USPC ..... 114/311; 43/43, 44; 441/136
See application file for complete search history.

(56) References Cited

U.S. PATENT DOCUMENTS

| | | | | |
|---|---|---|---|---|
| 2,818,042 | A * | 12/1957 | Manhart | 114/311 |
| 4,001,905 | A | 1/1977 | Givens | |
| 4,692,124 | A | 9/1987 | Harper et al. | |
| 5,921,830 | A | 7/1999 | Shoaff et al. | |
| 6,079,147 | A * | 6/2000 | Mosher | 43/44.95 |
| 6,206,743 | B1 | 3/2001 | Martin | |
| 6,375,529 | B1 | 4/2002 | Infante et al. | |
| 6,684,808 | B2 * | 2/2004 | Callahan | 114/311 |
| 6,685,520 | B1 | 2/2004 | Wiggins | |
| 2006/0213114 | A1 * | 9/2006 | Kumlin | 43/43.14 |
| 2009/0072426 | A1 * | 3/2009 | Regan | 264/45.3 |

FOREIGN PATENT DOCUMENTS

| | | | |
|---|---|---|---|
| GB | 788338 | A | 12/1957 |
| GB | 815638 | A | 7/1959 |
| GB | 1560222 | A | 1/1980 |
| GB | 1568712 | A | 6/1980 |
| GB | 2171069 | A | 8/1986 |
| GB | 2171364 | A | 8/1986 |

OTHER PUBLICATIONS

QualityPoolToys.com; Sevylor Float Pool Anchor Kit; http://www.qualitypooltoys.com/sefpa100.html; Screenshot dated Jun. 26, 2012.
Rave Raft Anchor; http://www.amazon.com/Rave-0100-RAVE-Raft-Anchor/dp/B000OZ6YHE; Screenshot dated Jun. 30, 2012.
Excalibur Plastic Pool Raft Anchor; http://www.overstock.com/Sports-Toys/Excalibur-Plastic-Pool-Raft-Anchor/5238042/product.html; Screenshot dated Jun. 26, 2012.

* cited by examiner

*Primary Examiner* — Lars A Olson
*Assistant Examiner* — Jovon Hayes
(74) *Attorney, Agent, or Firm* — Design IP

(57) ABSTRACT

The present application discloses a retention device for retaining an item in a body of water, for example a swimming pool. In some embodiments, the retention device comprises at least one water-fillable receptacle connected to a retention element—for example a strap—that is placed over the item that is to be retained. When an upward force is applied to the retention element in a direction generally away from the surface of the body of water, the filled water receptacle restricts upward movement of the attached retention element, thereby maintaining the item in the body of water.

20 Claims, 4 Drawing Sheets

APPARATUS FOR RETAINING AN ITEM IN A BODY OF WATER

CROSS REFERENCE TO RELATED APPLICATION

This application claims the benefit of U.S. Provisional Application No. 61/546,164, filed Oct. 12, 2011, which is incorporated by reference herein in its entirety as if fully set forth.

FIELD OF THE INVENTIVE CONCEPTS

The present inventive concepts relate to the field of apparatuses that are used to retain an item, for example a raft or other floating device, in a body of water.

BACKGROUND

Existing rafts and other inflatable and floating devices are often used in swimming pools and other bodies of water for swimming-assistance, emergency rescue, or leisure purposes. In swimming pools, for example, pool rafts are a commonly used leisure device. These pool rafts are prone to being blown off of the surface of the water and out of the pool entirely, where they may land on the ground and become dirty or damaged. This represents a nuisance to pool raft users, who have to continually clean their pool rafts before reinserting them into the pool in order to avoid, for example, dirt, sand, and grass clippings from being rinsed off directly into the pool or have to replace their rafts after they have become damaged. To prevent them from blowing out of the pool, pool users could repeatedly remove rafts from their pools between uses. This also represents a burden on pool users, as this process is time-consuming and requires sufficient storage space outside of the pool to accommodate the rafts.

Some efforts to produce retrofittable devices that can hold rafts in a swimming pool have included the use of weights connected to the rafts. These weights comprise materials having a higher density than that of water, for example a metal or sand, which materials sink in the pool water and thereby anchor the raft in the pool. The use of an anchor to hold the raft in the pool represents a drawback because these anchors may damage or deflate the raft as the weight of the anchor compresses the raft material. Further, anchors may break or come loose from the raft, thereby potentially damaging the pool liner or leaving debris, such as a pile of sand, on the pool bottom. Moreover, when these prior art devices are stored in the pool when not in use, for example by draping the device over the pool wall, the anchors may come into contact with the pool walls, thereby potentially damaging them.

Therefore, there is a need for a retrofittable apparatus for retaining an item in a body of water that overcomes the drawbacks and limitations of the prior art devices.

SUMMARY OF THE INVENTIVE CONCEPTS

In one respect, the present application discloses an apparatus for retaining an item in a body of water, the apparatus comprising a receptacle having a first opening that permits water to enter therethrough and at least partially fill the receptacle when it is located in the body of water and a second opening that permits at least some of the water in the receptacle to exit therefrom when it is located in the body of water, the receptacle having a plurality of cross-sectional areas taken along an axis that runs between the first opening and the second opening, the plurality of cross-sectional areas having an average cross-sectional area; and a retention element attached to the receptacle; wherein the average cross-sectional area is greater than a cross-sectional area of the second opening.

In another respect, the present application discloses an apparatus for retaining an item in a body of water, the apparatus comprising a first receptacle in the approximate shape of a truncated cone, the first receptacle having a first opening that permits water to enter therethrough and at least partially fill the first receptacle when it is located in the body of water, the first opening having a first cross-sectional area and a second opening that permits at least some of the water in the first receptacle to exit therefrom when it is located in the body of water, the second opening having a second cross-sectional area, the first cross-sectional area being greater than the second cross-sectional area; a second receptacle in the approximate shape of a truncated cone, the second receptacle having a third opening that permits water to enter therethrough and at least partially fill the second receptacle when it is located in the body of water, the third opening having a third cross-sectional area and a fourth opening that permits at least some of the water in the second receptacle to exit therefrom when it is located in the body of water, the fourth opening having a fourth cross-sectional area, the third cross-sectional area being greater than the fourth cross-sectional area; and a retention element attached between the first receptacle and the second receptacle.

In yet another respect, the present application discloses a method of retaining an item in a body of water, the method comprising placing a retention strap such that at least a portion of the item is located between the retention strap and a surface of the body of water, the retention strap being attached to a receptacle for holding water, wherein when the receptacle for holding water is at least partially filled with water, the retention strap is in contact with the item, and the value of an upward force that is being applied to the retention strap is less than or equal to an amount of force that is required to remove any slack from the retention strap, the receptacle for holding water applies a first force in a downward direction to the retention strap, and wherein when the receptacle for holding water is at least partially filled with water, the retention strap is in contact with the item, and the value of an upward force that is being applied to the retention strap for a first period of time is greater than the amount of force that is required to remove any slack from the retention strap, the receptacle for holding water applies a second force in a downward direction to the retention strap for a second period of time, wherein the value of the second force is greater than the value of the first force and the length of the first period of time is greater than or equal to the length of the second period of time.

BRIEF DESCRIPTION OF THE DRAWINGS

The foregoing summary, as well as the following detailed description of the inventive concepts, will be better understood when read in conjunction with the appended drawings. For the purpose of illustrating the inventive concepts disclosed herein, certain embodiments in accordance with the herein disclosed inventive concepts are shown in the drawings. It should be understood, however, that the herein disclosed inventive concepts are not limited to the precise arrangements shown. It should also be understood that, in the drawings, the parts are not necessarily drawn to scale. The present inventive concepts will hereinafter be described in conjunction with the appended drawing figures, wherein like numerals denote like elements. In the drawings.

DETAILED DESCRIPTION OF THE PREFERRED EMBODIMENTS

Figure 1:
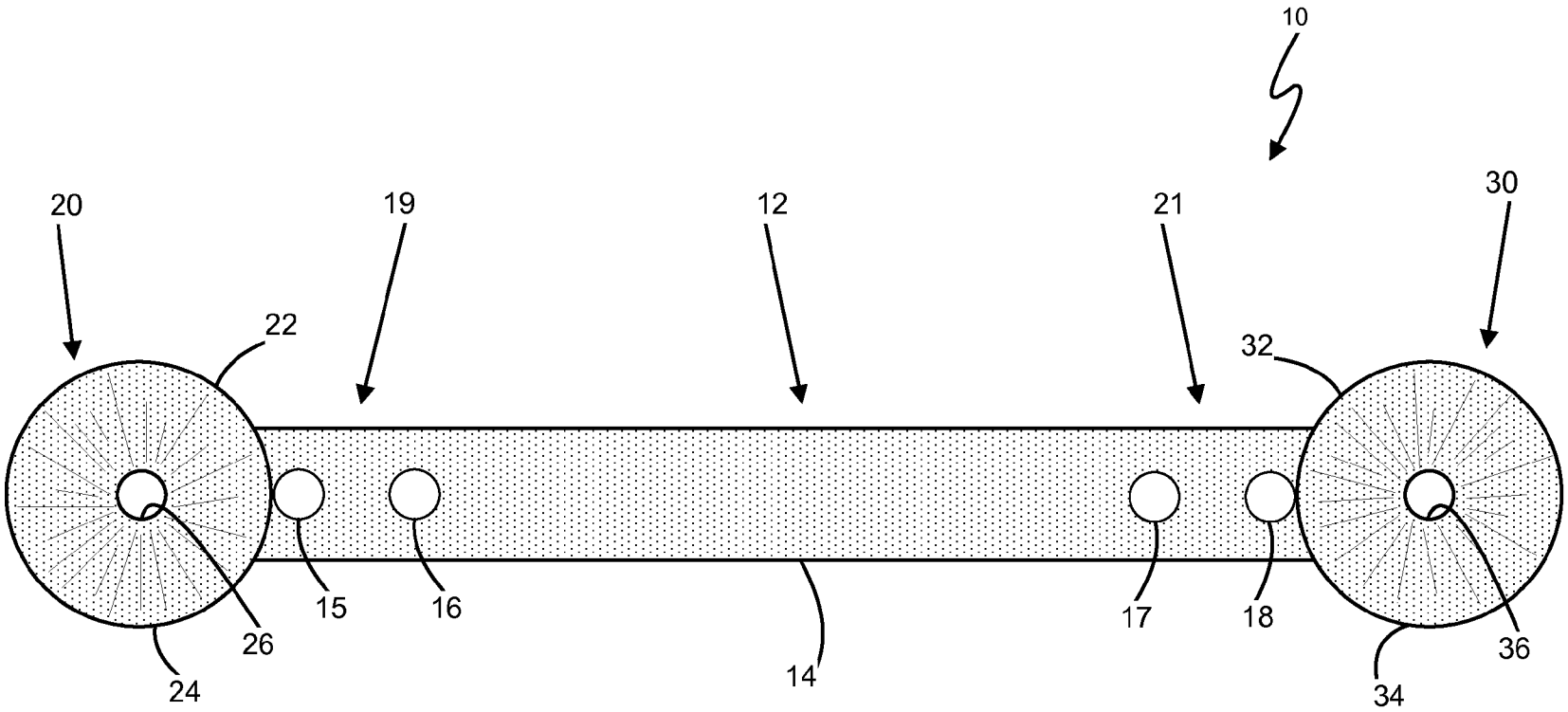
FIG. 1 shows a schematic top view of a first embodiment of an apparatus for retaining an item in a body of water in accordance with the present inventive concepts.

The ensuing detailed description provides preferred exemplary embodiments only, and is not intended to limit the scope, applicability, or configuration of the herein disclosed inventive concepts. Rather, the ensuing detailed description of the preferred exemplary embodiments will provide those skilled in the art with an enabling description for implementing the preferred exemplary embodiments in accordance with the herein disclosed inventive concepts. It is understood that various changes may be made in the function and arrangement of elements without departing from the spirit and scope of the inventive concepts, as set forth in the appended claims.

To aid in describing the inventive concepts, directional terms may be used in the specification and claims to describe portions of the present inventive concepts (e.g., upper, lower, left, right, etc.). These directional definitions are merely intended to assist in describing and claiming the inventive concepts and are not intended to limit the inventive concepts in any way. In addition, reference numerals that are introduced in the specification in association with a drawing figure may be repeated in one or more subsequent figures without additional description in the specification in order to provide context for other features.

For purposes of this application and the appended claims, the terms "anchor" or "anchoring" mean to apply a downward force on an object by means of attaching a mass to an object, the mass having a greater density than the fluid in which said mass is employed. For example, employing a lead weight attached to an object in a water medium under standard temperature and pressure conditions (STP) would constitute "anchoring" of said object under the provided definition, because lead has a greater density than water at STP.

For purposes of this application and the appended claims, the term "downward force" or reference to a force acting in a "downward" direction refer to a force or a component of a force that is applied in a direction that is in the same direction as or approximately in the same direction as the force of gravity.

For purposes of this application and the appended claims, the term "upward force" or reference to a force acting in an "upward" direction refer to a force or a component of a force that is applied in a direction that is opposite to or approximately opposite to the direction of the force of gravity.

Figure 2:
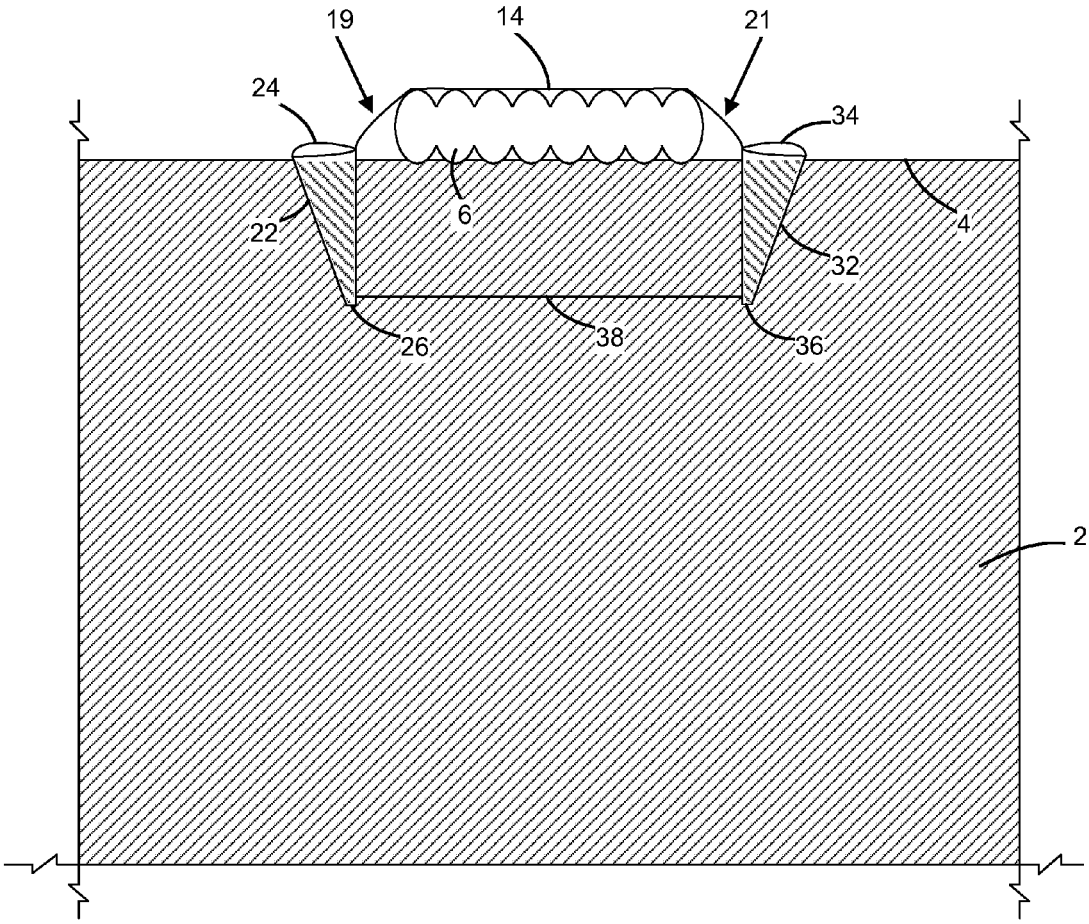
FIG. 2 shows a schematic side view of the apparatus of FIG. 1 employed in a body of water.

Referring to FIGS. 1 and 2, one embodiment of a retention device 10 for retaining an item in a body of water 2, for example a swimming pool, is shown. In this embodiment, the item to be retained is an inflatable pool raft 6. It should be understood that, in alternate embodiments, the item to be retained could be any lightweight, inflatable or floating item that is employed on the surface of a body of water for which it may be undesirable to permit the item to be blown away. For example, the item to be retained could be a swimming ring or tube, a floating mat, a pool noodle, or a beach ball or other inflatable toy. In some embodiments, the retention device 10 could be comprised of a vinyl or plastic material, for example polyvinyl chloride (PVC). Other suitable materials for the retention device 10 exist within the scope of the present inventive concepts, as will be appreciated by those having ordinary skill in the art.

In this embodiment, the retention device 10 has a center portion 12 and a pair of end portions 20,30. The center portion 12 comprises a retention strap 14 having a plurality of flow holes 15-18 located therein, as further discussed below. The end portion 20 comprises a water receptacle 22 and the end portion 30 comprises a water receptacle 32. Water receptacle 22 has an upper opening 24 and a lower opening 26, and water receptacle 32 has an upper opening 34 and a lower opening 36.

The specifics of water receptacle 22 will now be discussed. It should be understood that the discussion that follows is equally applicable to water receptacle 32. In this embodiment, as best seen in FIG. 2, when filled with water the water receptacle 22 takes on the approximate shape of a truncated cone (the bottom of the approximately conical shape is truncated to form the lower opening 26). In this embodiment, the upper opening 24 has a first cross-sectional area and the lower opening 26 has a second cross-sectional area, and the first cross-sectional area is greater than the second cross-sectional area. In alternate embodiments, the water receptacles could be of any suitable shape, for example cylindrical, spherical, ellipsoid, or an irregular shape such as an artistic representation of a fish, dolphin, or other water-inhabiting creature. In alternate embodiments, the first cross-sectional area could be equal to or less than the second cross-sectional area. In further alternate embodiments, the water receptacle could have a plurality of cross-sectional areas, the plurality of cross-sectional areas having an average cross-sectional area, and the average cross-sectional area could be greater than the cross-sectional area of the lower opening. In still further alternate embodiments, the water receptacle could have a plurality of cross-sectional areas that includes a median cross-sectional area, and the median cross-sectional area could be greater than the cross-sectional area of the lower opening.

When deployed in a body of water 2, the water receptacle 22 may be manually filled with water by dragging the water receptacle 22 along or below the water level 4 of the body of water 2. This forces water through the upper opening 24 and into the water receptacle 22, thereby at least partially filling the water receptacle 22. The unfilled end portion (in this example, end portion 30) of the retention device 10 would then be draped over the item to be retained (e.g., raft 6), and then the unfilled water receptacle (in this example, water receptacle 32) would be filled with water in a like manner, so that both water receptacles 22,32 would then be filled with water with the retention strap 14 located over the item to be retained (e.g., raft 6). In the alternative, the second water receptacle (in this example, water receptacle 32) could be at least partially filled with water before the retention strap 14 is placed over the item to be retained.

In this embodiment, the upper opening 24 of the water receptacle 22 is comprised of a thicker material than the remainder of the water receptacle 22, or multiple layers of material. The upper opening 24 of the water receptacle 22 is thereby made less flexible than the remainder of the body of the water receptacle 22, which assists in maintaining the upper opening 24 in an opened position. In alternate embodiments, the upper opening could be maintained in an opened position via the inclusion of a solid ring located around the perimeter of the upper opening 24. The ring could be, for example, sewn, stitched, folded, or glued into the receptacle material around the perimeter of the upper opening 24. The ring could be comprised of, for example, a metal, plastic, or wooden material. In further alternate embodiments, more than one ring or other device could be employed in order to maintain the upper opening 24 in an opened position. It should be understood that, in some embodiments, the water receptacles according to the present inventive concepts will not automatically fill with a suitable amount of water if merely placed in the pool, but must instead be manually filled in the manner described above. In other embodiments, the water receptacles will open automatically and fill with a suitable amount of water when placed in a body of water, without the need for dragging the water receptacles across the surface of the water or intentionally submerging the water receptacles in the body of water.

When an apparatus according to the present inventive concepts is not in use, it may be stored partially interior to and partially exterior to the pool, for example by placing one of the filled water receptacles exterior to the pool so that the water in said water receptacle drains out onto the ground via its respective lower opening. In this undeployed state, the retention strap may be draped over a sidewall of the pool such that one of the water receptacles remains filled with water and located in the pool, while the other water receptacle is empty and located exterior to the pool. When it is desirable to redeploy the retention device over an item to be retained, the user can grab the retention device by the unfilled end portion, place that end of the device over the item to be retained so that the retention strap is desirably located above the item to be retained, and then submerge the unfilled water receptacle so that it fills with water. The retention device will thus be retained in its desired position with the retention strap located above the item to be retained.

When the water receptacle 22 is filled with water, it will tend to locate itself substantially below the water level 4. Since the water in the water receptacle 22 is of the same density as the water located in the body of water 2, when the value of an upward force that is being applied to the retention strap 14 is less than or equal to an amount of force that is required to remove any slack in the retention strap 14, the water receptacle 22 either does not apply any downward force on the retention strap 14 or applies only a small amount of downward force on the retention strap 14. This non-existent or small amount of downward force may be referred to as a first force. When an upward force (e.g., the upward vertical component of a gust of wind) that has a value greater than a minimum amount of force that is required to remove any slack in the retention strap 14 is applied to the retention strap 14 for some first period of time, the weight of the water in the water receptacle 22 provides a downward force—which may be referred to as a second force—to the retention strap 14, and thus to the raft 6, for a second period of time, which may have a length that is equal to or less than the length of the first period of time, until either the upward force ceases (in which case, the first and second periods of time are equal) or the water receptacle 22 sufficiently empties of water such that it can no longer maintain the position of the retention strap 14 in opposition to the continued upward force (in which case, the first period of time is greater than the second period of time), thereby resulting in cessation of the second force. It should be understood that the second force will typically not remain constant during the second period, due to variations in the amount of water that will be present in the water receptacle 22 at any given moment. However, while it is acting on the retention strap 14, the second force is at all times greater than the first force. In some embodiments, the second force is at least twice the first force. In alternate embodiments, the second force may be between 2-20 times, or greater, that of the first force. The maximum length of the second period of time may vary, and may be affected by such factors as the total volume of water that is being held in the water receptacle 22 at the start of the second period of time, the size and shape of the water receptacle 22, and the size and shape of the lower opening 26 in the water receptacle 22. The water receptacle 22 acts to retain the raft 6 in the body of water 2 without anchoring the retention strap 14 and any contacted items (e.g., raft 6), and while applying little to no downward force to the raft 6 when no upward force is being applied thereto. Not only does this prevent damage to the retained item, but there is also no anchor present that could potentially damage the pool liner or walls. As an upward force of sufficient value is applied to the retention strap 14, the connected water receptacles 22,32—while restricting this upward force via the weight of the water in the water receptacles 22,32—will tend to be lifted above the water level 4 due to the draining of some of the water from the water receptacles 22,32 via the respective lower opening 26,36. Due to the presence of the lower openings 26,36, a lengthy, sustained upward force of sufficient value and duration on the retention strap 14 would act to substantially or fully empty the water out of the water receptacles 22,32, allowing the retention strap 14 to be relocated, and thereby permitting the item to be retained (e.g., raft 6) to be blown off of the surface of the body of water 2. However, under intermittent gusting conditions (i.e., intermittent, unsustained upward force on the retention strap 14), the water receptacles 22,32 in accordance with the present inventive concepts will begin to refill with water as soon as the upward force on the retention strap 14 ceases, thereby maintaining the connected retention strap 14 in the desired position.

While the water receptacle 22 is employed in the body of water 2, a certain volume of water will tend to flow out of the water receptacle 22 via lower opening 26 per unit time. As water cycles out of the water receptacle 22, the lost volume of water is replaced by fresh water entering the water receptacle via the upper opening 24 or lower opening 26. In this way, the water in the water receptacle 22 is prevented from becoming stagnant. The relative greater size of the cross-sectional area of the upper opening 24 vis-à-vis the lower opening 26 ensures that the water receptacle 22 remains filled with water while located in the pool. In other words, under normal conditions, the inflow rate of water into the water receptacle 22 through the upper opening 24 and/or lower opening 26 exceeds the outflow rate of water from the water receptacle 22 through the lower opening 26.

In this embodiment, the retention strap 14 is of a fixed length and, in cross-section, is approximately rectangular in shape. In alternate embodiments, it should be understood that the retention strap could be length- or width-adjustable, for example via the use of an adjustable clamp or buckle located along the center portion of the apparatus. In further alternate embodiments, the position of the one or more water receptacles may be adjustable along the length of the retention strap. In still further alternate embodiments, the retention strap could be shaped differently in order to accommodate items to be retained that are of fundamentally different shapes. For example, the retention strap could have a portion that is pouch- or pocket-shaped, in order to accommodate a spherical object to be retained (e.g., a beach ball), or could comprise a webbing or interweaving of separate retention strap portions. The pouch- or pocket-shaped retention strap portion could also have a draw string or adjustable member for adjusting the size and shape of said portion. In still further alternate embodiments, the retention strap could be slit lengthwise along its middle so that an item to be retained, for example a pool raft, could be slid into the slit and retained therein by the divided strap portions.

Figure 3:
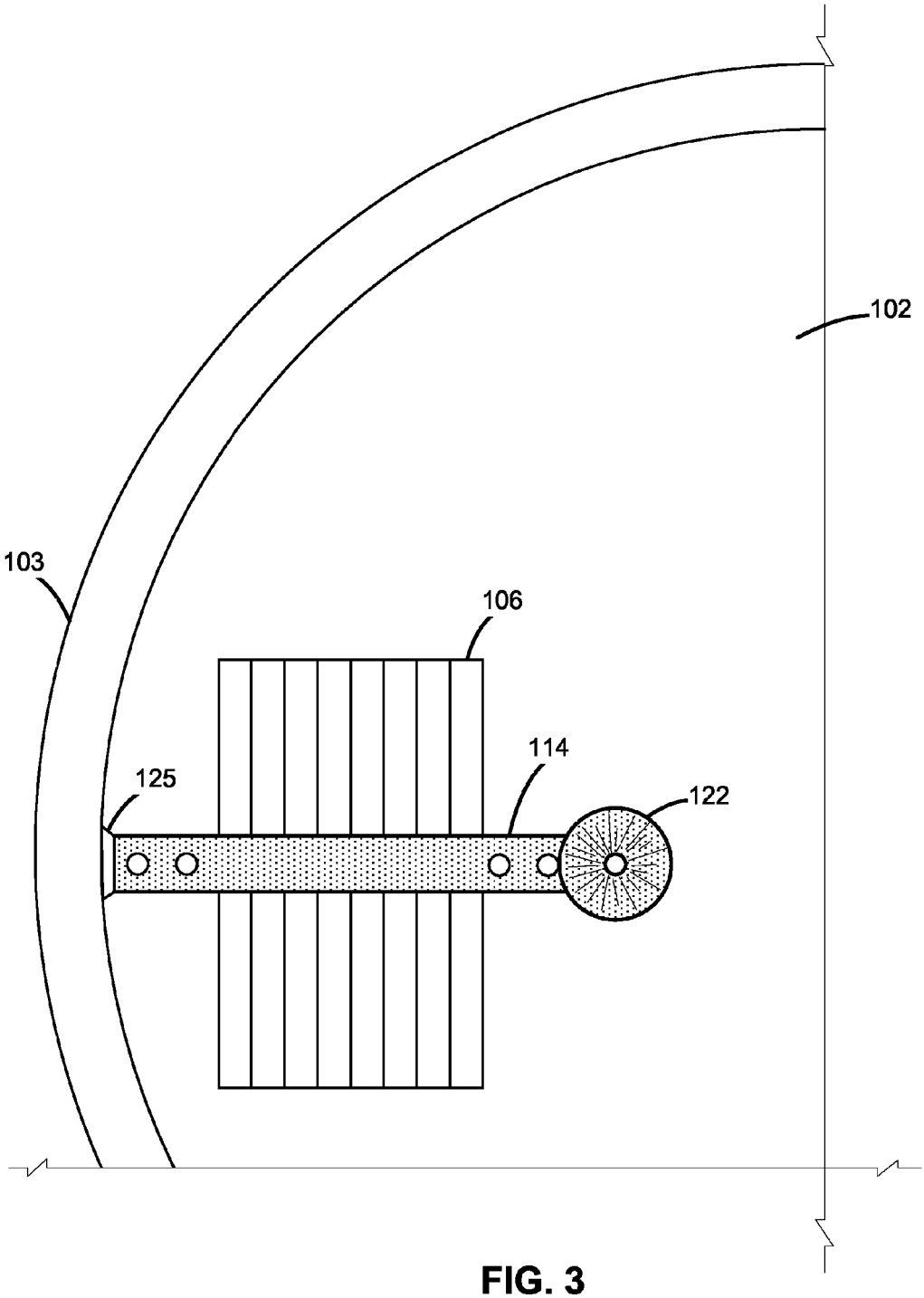
FIG. 3 shows a partial schematic view of a second embodiment of an apparatus in accordance with the present inventive concepts.

In alternate embodiments, as shown in the partial schematic view of FIG. 3, one end of the retention strap 114 could be releasably attached to the pool wall or edge 103 via a connection member 125, for example via a clamp, clasp, hook, eyelet, adhesive, or other suitable type of known fastener. The opposing end of the retention strap could include one or more water receptacles, for example water receptacle 122, as taught herein. In these embodiments, the connection of the retention strap 114 to the pool wall or edge 103 would maintain the position of one end of the retention strap 114, while the one or more water receptacles 122 located at the other end of the retention strap 114 would maintain the position of the second end of the retention strap 114. In this way, the position of the retention strap 114 could be maintained in a desirable position, for example above an item to be retained 106 in the pool 102. In further alternate embodiments, one end of the retention strap could be attached to the pool edge, and the other end of the retention strap could comprise multiple retention straps or a webbing or interweaving of separate retention strap portions, some or all of which could include one or more water receptacles.

Figure 4:
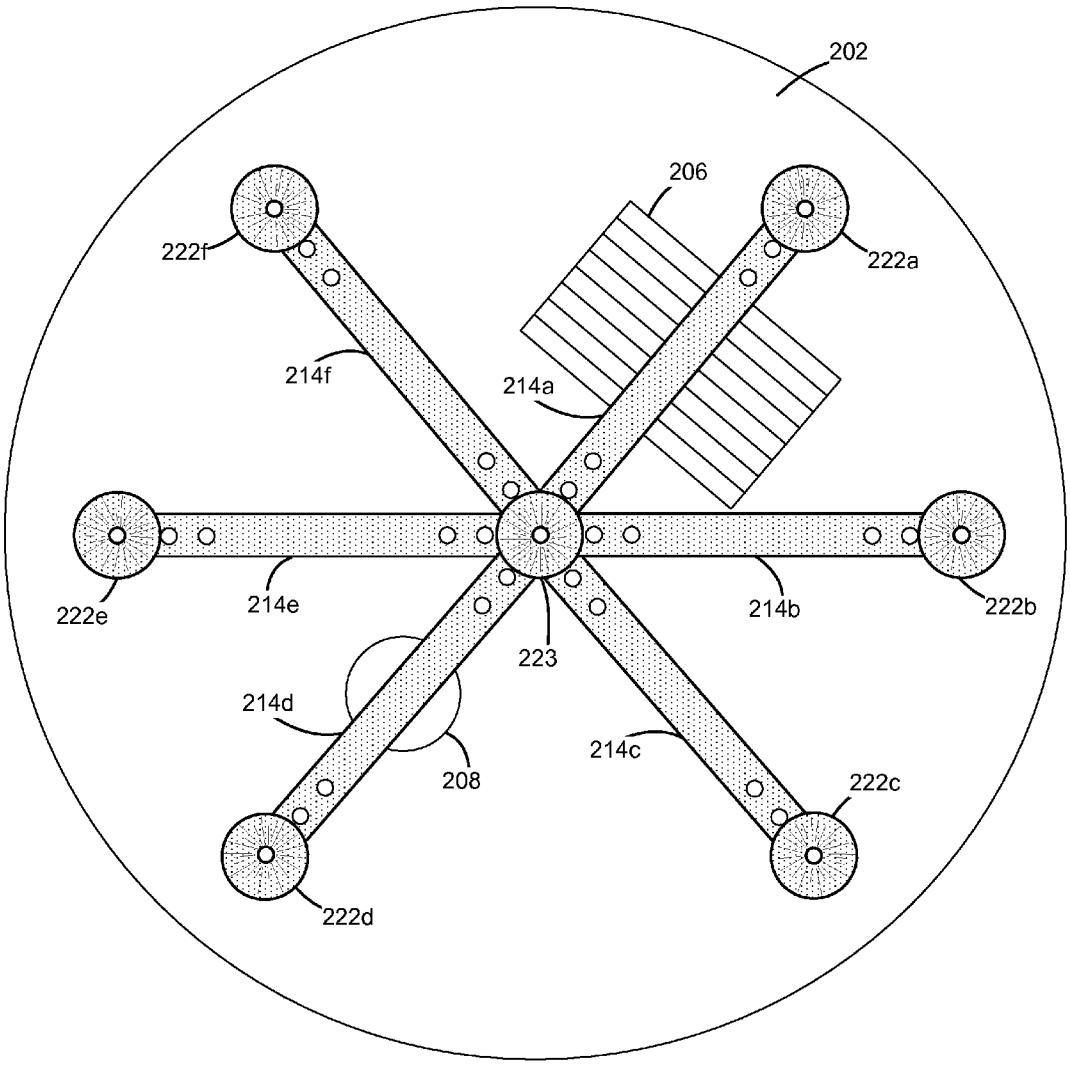
FIG. 4 shows a schematic view of a third embodiment of an apparatus in accordance with the present inventive concepts.

In further alternate embodiments, as shown in the schematic view of FIG. 4, the apparatus could include a floating center portion 223 from which multiple retention straps 214*a*-214*f* extend. The floating center portion 223 could consist of or include one or more water receptacles, in accordance with the present inventive concepts, attached thereto. In this embodiment, each of the multiple retention straps 214*a*-214*f* could include one or more water receptacles 222*a*-222*f* in accordance with the present inventive concepts. For example, the retention strap 214*a* could extend from the floating center portion 223 and include the water receptacle 222*a* at the end thereof, the retention strap 214*b* could extend from the floating center portion 223 and include the water receptacle 222*b* at the end thereof, etc. In the embodiment shown in FIG. 4, retention strap 214*a* is shown located above the item to be retained 206*a*, which in this embodiment is a raft, and retention strap 214*d* is shown located above the item to be retained 208, which in this embodiment is a spherical ball. As discussed above, the retention strap 214*d* could have a pouch or pocket shape (with or without a drawstring or adjustable member for adjusting the size and shape of said portion) and/or could comprise a webbing or interweaving of separate retention strap portions to better accommodate a spherical-shaped object and prevent it from being blown off of the surface of the body of water 202. If in the form of a water receptacle, the floating center portion 223 could be the same size as, or sized larger than, the water receptacles 222*a*-222*f*. The retention straps 214*a*-214*f* could be integrally molded with the floating center portion 223, or could be releasably attached thereto via any known and suitable type of fastener.

In still further alternate embodiments, the apparatus could include a single water receptacle and a single retention strap, the retention strap being of sufficient length to extend from the water receptacle, wrap around the item to be retained, and extend back to and attach with the single water receptacle. In other alternate embodiments, the retention strap may be length adjustable, include one or more water receptacles attached thereto, and also include means for releasable attachment to one or more "side straps," each of which may separately include one or more water receptacles attached thereto. Each of the side straps may themselves be length-adjustable and include movable water receptacle(s). Thus, a customizable arrangement of water receptacles and retention straps is made possible, as the situation may dictate.

Referring back to the embodiment of FIGS. 1 and 2, the retention strap 14 has a plurality of flow holes 15-18 located therein. These flow holes 15-18 are located at respective ends 19,21 of the retention strap 14, i.e., close to the end portions 20,30 where the water receptacles 22,32 are located. The flow holes 15-18 permit water to flow through the ends 19,21 of the retention strap 14, thereby helping to maintain the water receptacles 22,32 aimed downwardly in the body of water 2. In high wind conditions, where the raft 6 may be moved around the surface of the pool rapidly, the presence of the flow holes 15-18 significantly reduces the drag caused by the water coming in contact with the ends 19,21 of the retention strap 14. The flow holes 15-18 are sized large enough so that water may flow freely through them, but are not so large that they substantially weaken the retention strap 14. In this embodiment, the flow holes 15-18 are circular. In alternate embodiments, the flow holes could have any suitable shape and size within the scope of the present inventive concepts.

In order to maintain the water receptacles 22,32 aimed downwardly in the body of water 2 (as shown in the example of FIG. 2), optionally the bottom ends of the water receptacles 22,32 (i.e., the ends of the receptacles near the lower openings) could be releasably attached together by a connector 38, which could be, for example, a string, belt, or elastic material. The length of this connector 38 could be adjustable to accommodate a range of possible spacings between the water receptacles 22,32 when the apparatus is deployed. In embodiments where a connector 38 is used between the bottom ends of the water receptacles 22,32, the flow holes 15-18 may be omitted from the retention strap 14. Alternatively, the flow holes 15-18 may be omitted entirely from the retention strap 14, even if a connector 38 is not used between the bottom ends of the water receptacles 22,32.

In some embodiments, the water receptacles, when substantially filled with water, will hold at least 16 fluid ounces (0.473 L) of water. In alternate embodiments, the water receptacles, when substantially filled with water, will hold at least 32 fluid ounces (0.946 L) of water. When they are substantially filled with water and then removed from the body of water 2, the water receptacles will drain completely of water (excluding droplets of water that might temporarily adhere to the interior surface of the water receptacles) in not less than 2 seconds and not more than 30 seconds. In other embodiments, the water receptacles will drain completely of water, as defined above, in not less than 3 seconds and not more than 15 seconds.

It should be understood that the apparatus according to the present inventive concepts may be used as a retrofittable solution for maintaining an item, for example a pool raft, in a desired body of water. In other words, apparatuses according to the present inventive concepts may be designed and sold for the intended purpose of use with existing rafts and other floating devices. In addition, rafts and other types of floating devices may be provided with known means for attaching to a water receptacle, for example a belt loop, clamp, clasp, eyelet, a hook-and-loop fastener, an adhesive, or any other known type of suitable fastening means. Where the floating device is provided with suitable means for attachment with a water receptacle, embodiments according to the present inventive concepts could be provided wherein the retention strap is omitted entirely, and attachable water receptacle(s) are separately provided.

It will be appreciated that the foregoing is presented by way of illustration only, and not by way of any limitation, and that various alternatives and modifications may be made to the illustrated embodiments without departing from the spirit and scope of the present inventive concepts.

The invention claimed is:

1. An apparatus for retaining an item in a body of water, the apparatus comprising:

a first receptacle having a first opening that permits water to enter therethrough and at least partially fill the first receptacle when it is located in the body of water and a second opening that permits at least some of the water in the first receptacle to exit therefrom when it is located in the body of water, the first receptacle having a plurality of cross-sectional areas taken along an axis that runs between the first opening and the second opening, the plurality of cross-sectional areas having an average cross-sectional area;

a second receptacle having a first opening that permits water to enter therethrough and at least partially fill the second receptacle when it is located in the body of water and a second opening that permits at least some of the water in the second receptacle to exit therefrom when it is located in the body of water, the second receptacle having a plurality of cross-sectional areas taken along an axis that runs between the first opening and the second opening thereof, the plurality of cross-sectional areas having an average cross-sectional area; and a retention element having a first end and a second end, wherein the retention element is attached at the first end to the first receptacle and at the second end to the second receptacle;

wherein the average cross-sectional area of the first receptacle is greater than a cross-sectional area of the second opening of the first receptacle and wherein the average cross-sectional area of the second receptacle is greater than a cross-sectional area of the second opening of the second receptacle.

2. The apparatus of claim 1, wherein the first opening of the first receptacle has a cross-sectional area, and the cross-sectional area of the first opening of the first receptacle is greater than the cross-sectional area of the second opening of the first receptacle.

3. The apparatus of claim 1, wherein the first opening of the second receptacle has a cross-sectional area, and the cross-sectional area of the first opening of the second receptacle is greater than the cross-sectional area of the second opening of the second receptacle.

4. The apparatus of claim 1, further comprising a connector that is releasably attachable between a bottom end of the first receptacle and a bottom end of the second receptacle.

5. The apparatus of claim 1, wherein when either of the first receptacle and the second receptacle is at least partially filled with water it takes on a shape approximating a truncated cone.

6. The apparatus of claim 1, wherein the retention element has a length, and a position of either or both of the first receptacle and the second receptacle along the length of the retention element is adjustable.

7. The apparatus of claim 1, wherein a length of the retention element is adjustable.

8. The apparatus of claim 1, wherein the retention element comprises a webbing or interweaving of separate retention portions.

9. The apparatus of claim 1, wherein the retention element has at least one integral hole therein that permits water to flow therethrough.

10. An apparatus for retaining an item in a body of water, the apparatus comprising:

a first receptacle having a first opening that permits water to enter therethrough and at least partially fill the first receptacle when it is located in the body of water and a second opening that permits at least some of the water in the first receptacle to exit therefrom when it is located in the body of water;

a second receptacle having a third opening that permits water to enter therethrough and at least partially fill the second receptacle when it is located in the body of water and a fourth opening that permits at least some of the water in the second receptacle to exit therefrom when it is located in the body of water; and a retention element having a central portion that is adapted to be placed over the item such that the item is located between the central portion and the body of water, the retention element having a first end that is attached to the first receptacle and a second end that is attached to the second receptacle.

11. A method of retaining an item in a body of water, the method comprising:

placing a retention strap such that at least a portion of the item is located between the retention strap and a surface of the body of water, the retention strap being attached to a receptacle for holding water, wherein when the receptacle for holding water is at least partially filled with water, the retention strap is in contact with the item, and the value of an upward force that is being applied to the retention strap is less than or equal to an amount of force that is required to remove any slack from the retention strap, the receptacle for holding water applies a first force in a downward direction to the retention strap, and wherein when the receptacle for holding water is at least partially filled with water, the retention strap is in contact with the item, and the value of an upward force that is being applied to the retention strap for a first period of time is greater than the amount of force that is required to remove any slack from the retention strap, the receptacle for holding water applies a second force in a downward direction to the retention strap for a second period of time, wherein the value of the second force is greater than the value of the first force and the length of the first period of time is greater than or equal to the length of the second period of time.

12. The method of claim 11, wherein the value of the first force is zero.

13. The method of claim 11, wherein the value of the second force is at least twice that of the first force.

14. The method of claim 11, wherein the receptacle for holding water is attached to a first end of the retention strap, the retention strap further comprising a second end having a connection member, the method further comprising:

attaching the connection member to an object such that a position of the second end of the retention strap is maintained when attached to the object.

15. The method of claim 14, wherein the attaching step comprises attaching the connection member to a wall of a pool.

16. The method of claim 11, further comprising a second receptacle for holding water, the receptacle for holding water being attached to a first end of the retaining strap and the second receptacle for holding water being attached to a second end of the retaining strap, the method further comprising:

allowing the receptacle for holding water and the second receptacle for holding water to at least partially fill with water.

17. The method of claim 11, further comprising:

removing the receptacle for holding water from the body of water so that the water in the receptacle for holding water drains therefrom.

18. The apparatus of claim 1, wherein the plurality of cross-sectional areas of the first receptacle has a median cross-sectional area, and the median cross-sectional area is greater than the cross-sectional area of the second opening of the first receptacle.

19. The apparatus of claim 1, wherein the retention element comprises a portion that is pouch- or pocket-shaped.

20. The apparatus of claim 10, wherein the retention element has at least one integral hole therein that permits water to flow therethrough.

* * * * *